United States Patent [19]

Alston et al.

[11] Patent Number: 4,947,025

[45] Date of Patent: Aug. 7, 1990

[54] PORTABLE ELECTRIC WATER HEATER FOR OUTDOOR USE

[76] Inventors: Gregory A. Alston, 917 Tabb Lakes Dr., Tabb, Va. 23602; Kirt R. Cattron, 355 Old Quary Way, Boiselk, Id. 83709

[21] Appl. No.: 210,316

[22] Filed: Jun. 22, 1988

[51] Int. Cl.[5] ..... H05B 1/02; F24H 1/06; F24H 1/16; B05B 1/24

[52] U.S. Cl. ..... 219/303; 219/301; 219/305; 219/308; 219/309; 239/130; 239/135

[58] Field of Search ..... 219/296–299, 219/301–309; 239/133, 135, 136, 137, 138, 130; 4/598; 16/35 R; 122/250 R

[56] References Cited

U.S. PATENT DOCUMENTS

| | | | |
|---|---|---|---|
| 491,320 | 2/1893 | Mitchell | 219/296 |
| 764,674 | 7/1904 | Pemberton | 219/296 X |
| 808,525 | 12/1905 | Erie | 219/296 X |
| 890,053 | 6/1908 | Hemriksen | 219/302 |
| 1,077,035 | 10/1913 | Boyer | 219/298 X |
| 1,120,830 | 12/1914 | Mann . | |
| 1,225,631 | 5/1917 | Hinkle | 219/304 |
| 1,293,896 | 2/1919 | Paasche . | |
| 1,376,485 | 5/1921 | Verstraete | 219/303 X |
| 1,509,140 | 9/1924 | Groulx | 219/303 |
| 1,561,706 | 11/1925 | Duffie | 219/303 |
| 1,595,819 | 8/1926 | Bluemlein | 219/304 |
| 1,670,032 | 5/1928 | Gibbons | 219/303 |
| 1,673,567 | 6/1928 | Hynes . | |
| 1,688,108 | 10/1928 | Berger | 219/303 |
| 1,724,767 | 8/1929 | Mercer | 219/303 |
| 2,024,783 | 12/1935 | Smith . | |
| 2,091,838 | 8/1937 | Staak | 239/135 X |
| 2,097,166 | 10/1937 | Stone | 219/303 |
| 2,420,175 | 5/1947 | Johnstone . | |
| 2,472,713 | 6/1949 | Li Joi | 219/304 |
| 2,861,838 | 11/1958 | Wyatt et al. | 239/137 |
| 2,879,372 | 3/1959 | Dammond | 219/304 |
| 2,905,275 | 9/1959 | Kostelecki et al. | 16/35 R |
| 2,923,480 | 2/1960 | Christian | 239/135 X |
| 2,987,259 | 6/1961 | Lindquist | 239/130 |
| 3,431,565 | 3/1969 | Nelson | 4/598 |
| 3,811,414 | 5/1974 | Minton | 239/136 X |

FOREIGN PATENT DOCUMENTS

| | | | |
|---|---|---|---|
| 525001 | 5/1921 | France | 4/598 |
| 1067010 | 1/1954 | France | 219/301 |
| 464476 | 12/1968 | Switzerland | 219/303 |
| 403144 | 12/1933 | United Kingdom | 219/303 |

*Primary Examiner*—Anthony Bartis
*Attorney, Agent, or Firm*—Wallace J. Nelson

[57] ABSTRACT

A portable electric water heater for supplying a continuous flow of hot water for outdoor home use includes an impact resistant waterproof housing having a coiled water conducting cooper tube disposed therein and wrapped with an electrical resistance heating element. A manually operated rheostat adjusts the heating current received through a power cord from a standard 110 Volt current source. The tube has a cold water inlet and a hot water outlet adapted to fit standard garden hoses and faucets. Wheels and legs support the housing and a handle facilitates movement thereof. Alternate smaller versions employ skid runners or caster wheels for portability and may have conducting tube sections positioned in a horizontal plane adjacent a respective heating element.

Each embodiment utilizes an on/off toggle switch and a flow responsive pressure switch in series with the rheostat. A pop-off valve is also provided. The rheostat is arranged in circuit to permit preheating of the water by a minimum current flow when the flow switch is open due to lack of water flow through the tube.

8 Claims, 2 Drawing Sheets

PORTABLE ELECTRIC WATER HEATER FOR OUTDOOR USE

FIELD OF THE INVENTION

This invention relates generally to electric water heaters and relates in particularly to portable electric water heaters adapted for outdoor use around the house.

BACKGROUND OF THE INVENTION

It is a routine chore for the modern day homeowner to wash the family pet, family car, driveway, fill outdoor wading pools, and the like, from an outdoor water faucet supply. This chore becomes an inconvenience when the weather is cool and the only source of water is from an outdoor cold water faucet. Also, cold water in a child's wading pool is not always pleasant to the child, or desired by the parent, even on warm days. A temporary source of warm or hot water for these chores would be a welcome relief and convenience and could make the task more enjoyable to the homeowner, his pets, and his children. There is thus, a need in the art for a portable hot water heater that may be connected to an outside faucet to provide a temporary source of warm or hot water.

SUMMARY OF THE INVENTION

Accordingly, it is an object of the present invention to provide a portable electric hot water heater that may be attached to an outdoor cold water faucet and provide a temporary but continuous flow of warm or hot water for outdoor use.

It is another object of the present invention to provide an inexpensive portable hot water heater.

Another object of the present invention is to provide a portable hot water heater that has a selective water temperature range.

A further object of the present invention is to provide a lightweight, durable and portable hot water heater for outdoor use.

An additional object of the present invention is a portable electric hot water heater that supplies continuous hot water from an outside cold water faucet source.

According to one aspect of the present invention the foregoing and additional objects are attained by providing a housing containing a coiled water conducting tube disposed therein, and an electrical heating element disposed adjacent the coiled water conducting tube and connected to a variable electric energy source. The coiled water conducting tube extends through the housing, connecting at one end to a hose leading from the outdoor faucet and connecting at the other end to a dispensing hose. Two or more wheels may be disposed in the bottom of the housing to facilitate movement thereof from a stowed area to the outdoor area of use. Since no water is stored within the coiled water conducting tube during periods of non-use, the entire assembly is relatively light. The water outlet end of the coiled water conducting tube exits near the bottom of the housing and leads therefrom to the bottom coil of the coiled tube to facilitate drainage of contained water when the water supply to the coil is discontinued. This drainage is readily accomplished by tilting the housing over onto the side carrying the outlet connection. A suitable handle is attached to the housing to facilitate movement of the heater and also assist in tilting the housing for drainage purposes. Drainage of the heater during periods of non-use permit storage of the heater in unheated outbuildings, garages, and the like, without concern of freeze damage.

BRIEF DESCRIPTION OF THE DRAWINGS

A more complete appreciation of the invention and many of the attendant advantages thereof will be readily appreciated as the same becomes better understood by reference to the following detailed description when considered in connection with the accompanying drawings.

Figure 1:
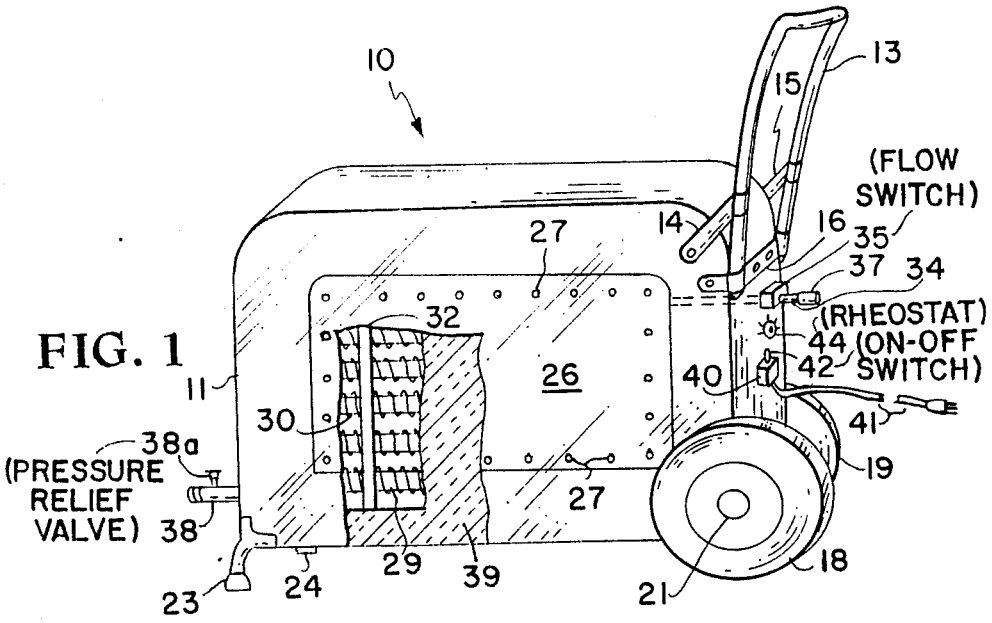
FIG. 1 is perspective side view of the preferred embodiment of the present invention with parts broken away.

Referring now to the drawings and more particularly to FIG. 1, the preferred embodiment of the portable water heater of the present invention is shown and designated generally by reference numeral 10. Water heater 10 includes a housing 11 having a handle 13 secured thereto via brackets 14, 15 and 16. Brackets 14, 15 and 16 are bolted or otherwise conventionally attached to housing 11 at the aft top surface thereof. Housing 11 is supported by a pair of wheels 18, 19 disposed on axle 21 attached to the aft end of housing 11 and a pair of legs 23, 24 disposed on opposite sides of the front of housing 11.

An access door 26 is bolted to the side of housing 11 via a plurality of bolts 27. A coiled water conducting tube 29, having an electrical resistance heating element 30 encircling each coil thereof, is supported within housing 11 via a plurality of ceramic or other non-conducting support brackets 32. In the preferred embodiment, coiled water conducting tube 29 is constructed from one-half inch copper tubing. The copper tubing is a excellent heat conductor and facilitates rapid heating of the contained water flow through the tubing. An inlet end 34 of coiled water conducting tube 29 extends through the aft end of housing 11 and is connected to a flow switch 35. A female hose coupling 37 is secured to the tip of inlet end 34 and serves to receive a male end of a garden hose, or the like, water conduit leading from an outside cold water faucet. The outlet end 38 of coiled water conducting tube 29 extends through the forward end of housing 11 adjacent the bottom thereof, for connection with a dispensing garden hose, in a conventional manner. Suitable nuts (not illustrated) are threaded onto the inlet and outlet ends of water conducting tube 29 so as to contact the interior and exterior of housing 11 at each location to assist in maintaining tube 29 in position. A layer of thermal insulation 39 completely lines the inside of housing 11, including access door 26, to confine the heat generated by electric resistance heating element 30 to the interior of housing 11. A pressure relief pop-off valve 38*a* is provided on outlet end 30 and serves as a safety outlet for relieving excess steam that might be accumulated within coiled water conducting tube 29 in the event other safety controls fail. A water proof electric switch box 40 is secured to the aft end of housing 11 and is equipped with a grounded electric cord 41 for connection to a conventional 110 volt A.C. household electric outlet. An on-off toggle switch 42 is provided on switch box 40 for selectively applying the current to heater 10 after cord 41 is connected to the household current source.

Figure 1A:
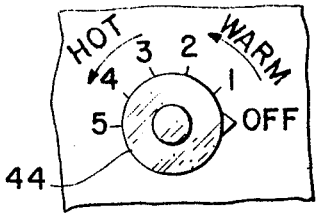
FIG. 1*a* is a view of the rheostat control for the portable water heater shown in FIG. 1.

A rheostat 44 (FIGS. 1 and 1*a*) is also secured to the aft end of housing 11 and in electrical connection with the circuit leading to electrical resistance heating element 30. Rheostat 44 serves to control the amount of current applied to, and thus the heating output of, electrical resistance heating element 30.

Figure 2:
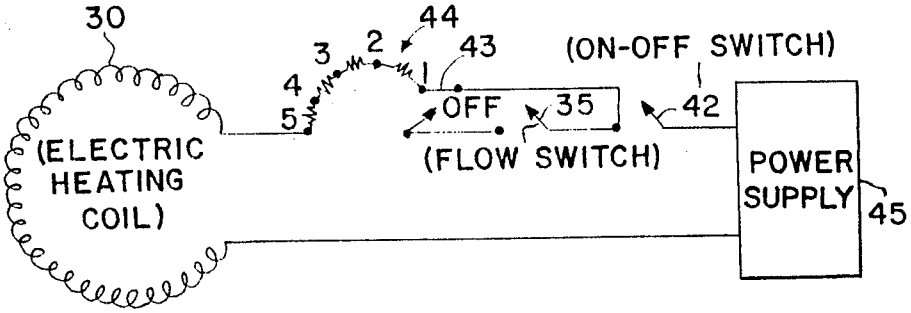
FIG. 2 is a schematic representation of the electrical circuit employed in the portable water heater shown in FIG. 1.

Referring now more particularly to FIG. 2, the schematic electrical circuit shown therein illustrates some of the operational and safety features of the present invention. As shown therein, the current is supplied to electrical resistance heating element 30 from the power source supply 45. After connection to the power source supply 45 manual toggle switch 42 must be moved to closed position. When switch 42 is closed current flows through setting "1" on rheostat 44 via contact 43. This activates heating element 30 to preheat or warm the coiled conducting tube associated therewith. During this preheat or warming cycle no water is actually flowing through the coiled water conducting tube. When the dispensing hose is opened water flows from the faucet source via inlet 34 and flow switch 35 is activated or closed. Rheostat 44 may then be moved from "off" to one of the settings 1, 2, 3, 4 or 5 to regulate the current flowing to heating element 30. The setting of rheostat 44 then controls the current to heating element 30. Maximum current flow and maximum heating of the water flowing through coiled water conducting tube 29 is attained when rheostat 44 is set on "5". When rheostat 44 is set at "1" and/or when the manual switch is "on", only enough current flows to heating element 30 to warm the coiled water conducting tube and there is no danger of overheating or generation of steam within the coiled tube.

Flow switches suitable for use in practice of the present invention are obtainable from the Harvil Corporation, 17th and Colorade, Santa Monica, California, 90404.

Panel mounted rheostats suitable for use in practice of the present invention are available from Jenkins Electric Co. Inc., Department SA, P.O. Box 32127, Charlotte, North Carolina 28232-2127.

Figure 3:
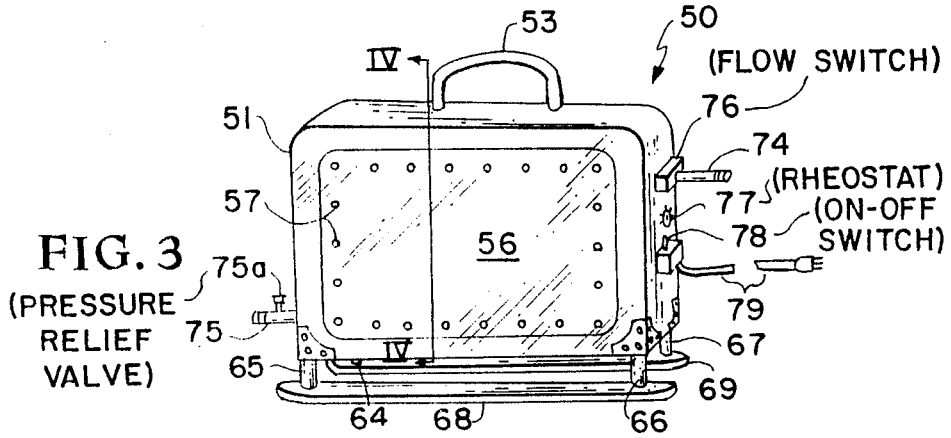
FIG. 3 is a view of another embodiment of the present invention.
Figure 4:
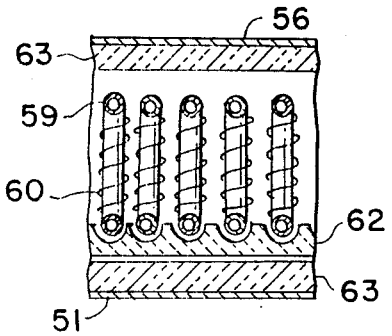
FIG. 4 is a view of the embodiment shown in FIG. 3 and taken along line IV—IV thereof.

Referring now to FIG. 3, a smaller and modified portable hot water heater according to the present invention is shown and designated generally by reference numeral 50. Portable heater 50 is provided with a housing 51 having a handle 53 secured to the top thereof to facilitate carrying of the heater. An access door 56 is bolted to housing 51 via a plurality of bolts 57 to permit installation of coiled water conducting tube 59 and the electric resistance wire heater element 60 therefor (FIG. 4) A layer of thermal insulation 63 lines housing 51 and access door 56, as in the embodiment of FIG. 1. Also, as in the previously described embodiment, the electrical resistance heating element 60 encircles each coil of coiled water conducting tube 59. Coiled water conducting tube 59 and electric resistance heating element 60 are supported in vertical orientation, and maintained in position by, a plurality of ceramic or other non-conducting support brackets attached to the top and bottom of housing 51, one of which is shown in FIG. 4 and designated by reference numeral 62.

Housing 51 is supported by four legs 64, 65, 66, 67 bolted or otherwise conventionally attached thereto. A pair of skid runners 68,69 are attached to respective leg pairs 65,66 and 64,67. Inlet end 74 and outlet end 75 of coiled water conducting tube 59, as well as pressure relief pop-off valve 75*a*, flow switch 76, rheostat 77, toggle switch 78, and electric plug cord 79, all perform in the same manner as like elements described previously in reference to the embodiment of FIG. 1.

Portable electric heater 50 is smaller than heater 10 and is accordingly, more easily moved. Thus, the unit 50 may be picked up by handle 53 and easily moved to the site of use by the housewife or teenager. Also, once in use a slight tug on the dispensing hose connected to outlet end 75 of coiled water conducting tube 59 will cause heater 50 to slide along the ground or other contacting surface via skid runners 68, 69.

Figure 5:
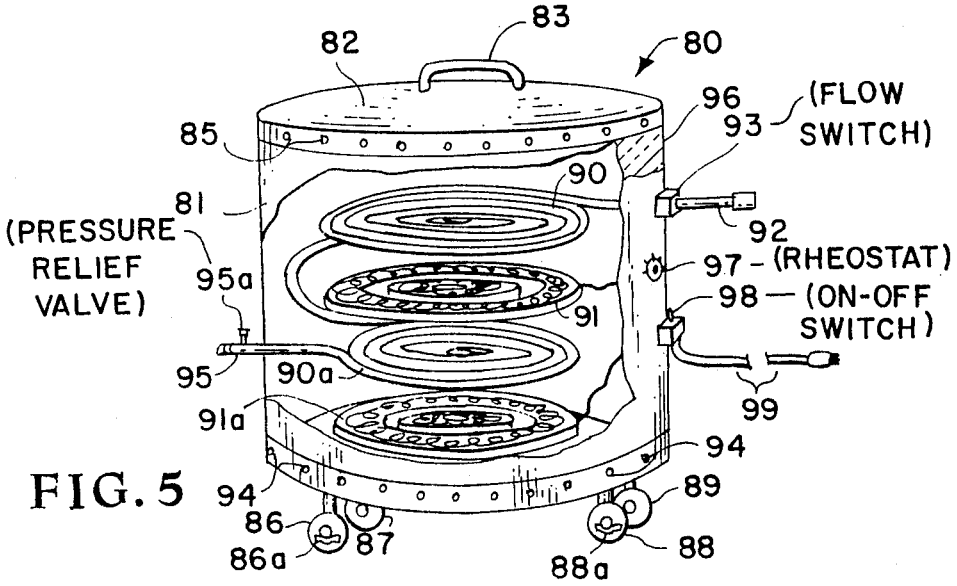
FIG. 5 is a view of another embodiment of the present invention with parts broken away.

Referring now to FIG. 5 another embodiment of the portable hot water heater of the present invention is shown and is designated generally by reference numeral 80. Portable heater 80 is provided with a cannister type housing 81 having an access top 82 provided with a handle 83. A plurality of bolts 85 serve to secure access top 82 to housing 81. Four cannister wheels 86, 87, 88, and 89 are disposed on the bottom of housing 81 to facilitate movement thereof. Each caster wheel is provided with a manually operated lock brake, two of which are shown and designated by reference numerals 86*a* and 88*a*. Portable heater 80 is provided with two sections of connected coiled water conducting tube, as designated by reference numerals 90 and 90*a*. An inlet end 93 of coiled water conducting tube section 90 extends through the side wall of housing 81 and flow switch 93 and terminates with a female coupling (not designated) for connection to a hose leading from an outside water faucet. Coil sections 90 and 90*a* are tightly coiled and lay flat in a plane adjacent ceramic housed resistance heating elements 91, 91*a*. Heating elements 91, 91*a* are disposed in coiled sections maintained in ceramic frame holders. An outlet end 95 of coiled water conducting tube 90*a* extends through housing 81 and is provided with a threaded male end (not designated) for connection with a dispensing hose and a pressure relief pop-off safety valve 95*a*, as in the previously described embodiments. Housing 81 is also lined with a blanket of thermal insulation 96 along the sidewall, top and bottom thereof. A rheostat control 97, toggle on/off switch 98 and electric cord 99 for connection to a source of house current operate as like elements described in the other embodiments and as illustrated in FIG. 2.

Portable heater 80 is the most compact of the embodiments described herein. A single coiled water conducting section, or any number of additional coiled water conducting sections, as well as only one or any number of additional resistance heating elements, may be employed in this embodiment, when so desired. In this respect, separate resistance heating element units may also be positioned on and facing the top and bottom surface of each coiled water conducting section. When utilizing a single coiled water conducting section the housing is reduced in size to resemble a conventional push-type lawn mower.

It is thus seen that each embodiment of the present invention provides a novel, lightweight, inexpensive, portable hot water heater system that has multiple uses for the modern day homeowner. Each embodiment described and illustrated herein may be readily handled by the homeowner, housewife or teenager, with relative ease. Larger portable hot water heaters may obviously be constructed of similar but larger components (larger housings and longer coiled water conducting tubes) where larger volumes and higher temperature hot water are needed for a particular use.

Also, as used herein the term "coiled water conducting tube" is intended to include coils positioned in the horizontal or vertical plane and they may be circular, oval, figure eight, straight sections with arcurate connecting ends, and the like configurations that may provide maximum utilization of the available housing interior space. Thus, although the invention has been described relative to specific embodiments thereof, it is not so limited.

No specific materials have been described for constructing the housing employed in each of the embodiments and any suitable lightweight metal e.g. an aluminum alloy, thin sheet steel, or the like, as well as thermal resistant plastics and composites, are considered operable and practical in the practice of the present invention. The only criteria being that the housing should be adequately rigid and impact resistant to withstand normal homeowner use. Any suitable thermal insulation blanket material, e.g. fiberglass insulation of adequate thickness to maintain the exterior of the heater housing sufficiently cool to permit handling during use thereof, is considered usable in the practice of the present invention. The various handles, support wheels, legs, skids and the like illustrated in the different embodiments are interchangeable and any one or combination thereof may be employed in any specific embodiment. Also, in lieu of the access doors shown in the embodiments of FIGS. 1 and 3 and the top shown in the embodiment of FIG. 5, the housing may take the form of a unitary cover bolted or otherwise conventionally attached to a base structure, as by bolts 94 shown in FIG. 5.

These and other numerous modifications and variations of the present invention that will be readily apparent to those skilled in the art in the light of the above teachings are considered to be incorporated herein. It is therefore to be understood that the invention may be practiced other than as specifically described without departing from the spirit and scope of the appended claims.

What is claimed as new and desired to be secured by Letters Patent of the United States is:

1. A portable electric water heater comprising:

a housing;

a coiled water conducting tube disposed within said housing;

electric heating means adapted to be connected through an on/off switch to an external power supply and contained within said housing;

said heating means being disposed in heat exchange relationship with said coiled water conducting tube;

water inlet means connected to one end of said coiled water conducting tube and extending through said housing to the exterior thereof;

water outlet means connected to the other end of said coiled water conducting tube and also extending through said housing to the exterior thereof;

said water outlet means extending from the bottom area of said coiled water conducting tube to facilitate draining the water from said coiled water conducting tube for storage of said heater;

a rheostat for selectively varying the current supplied to said electric heating means to thereby regulate the temperature of the heated water flowing through said coiled water conducting tube;

a pressure relief pop-off valve on said water outlet to relieve any excessive steam that might develop in said coiled water conducting tube;

thermal insulation means lining said housing and spaced from said coiled water conducting tube to insulate said housing from heat generated by said electric heating means;

said electric heating means including an electric circuit having an electrical conductor leading from said on/off switch and in direct connection with said rheostat means to engage the minimum current setting position of said rheostat means, a flow control switch disposed in series with said rheostat in said electric circuit, said electrical conductor being arranged to by-pass said flow control switch and permit minimum current flow through said electric circuit to effect preheating or warming of said water conducting coil when said flow switch is in the open position due to lack of water flow therethrough;

means, including a handle, attached to said water heater to facilitate manual movement thereof; and at least one access door removably attached to said housing, said access door being of adequate size to permit installation and maintenance of said coiled water conducting tube and said electrical heating means.

2. The portable electric water heater of claim 1 including a pair of wheels disposed on one end of the bottom of said housing for rotatably supporting said housing and a pair of fixed vertical leg supports disposed on the bottom of the other end of said housing.

3. The portable electric water heater of claim 1 wherein said means attached to said water heater to facilitate manual movement thereof comprises a handle secured to the top of said housing, four caster wheels rotatably attached to the bottom of said housing, and further including lock brake means secured to at least one of said caster wheels.

4. The portable electric water heater of claim 1 wherein said means attached to said water heater to facilitate manual movement thereof comprises a plurality of legs extending from the base of said water heater housing and at least a pair of skid runners attached to said legs.

5. The portable water heater of claim 1 wherein said coiled water conducting tube is formed as a flat tightly wound coil and disposed in a horizontal plane within said housing and said heating means comprises at least one flat ceramic holder containing a coiled resistance wire heat element.

6. The portable electric water heater of claim 1 including a plurality of ceramic brackets maintaining said coiled water conducting tube and said electric heating means in fixed position within said housing.

7. A portable electric water heater comprising:

a housing;

a coiled water conducting tube disposed within said housing;

electric heating means adapted to be connected to an external power supply and contained within said housing;

said electric heating means being disposed in heat exchange relationship with said coiled water conducting tube and including resistance wire heater coils encircling individual coils of said coiled water conducting tube;

water inlet means connected to one end of said coiled water conducting tube and extending through said housing to the exterior thereof;

water outlet means connected to the other end of said coiled water conducting tube and also extending through said housing to the exterior thereof;

said water outlet means extending from the bottom area of said coiled water conducting tube to facilitate draining the water from said coiled water conducting tube for storage of said heater;

means for selectively varying the current supplied to said electric heating means to thereby regulate the temperature of the heated water flowing through said coiled water conducting tube;

said means for selectively varying the current supplied to the electric heater means including an electric circuit for said resistance wire heater coils;

said electric circuit including a connection cord to connect said electric circuit to a power source;

an on/off switch, a flow switch and a rheostat control disposed in series in said electric circuit;

said rheostat being provided with a control knob movable from an "off" position to various control settings to select a range of current flow from a minimum current to a maximum current flow through said electric circuit to said resistance wire heater coils;

said electric circuit for said resistance wire heater coils also including an electrical conductor leading from said on/off switch and in direct connection with said rheostat control to engage the minimum current setting position of said rheostat, said conductor being arranged to by-pass said flow control switch and permit minimum current flow through said electric circuit to said resistance wire heater coils and effect preheating or warming of said water conducting coil when said flow therethrough;

a pressure relief pop-off valve on said water outlet to relieve any excessive steam that might develop in said coiled water conducting tube;

thermal insulation means lining said housing and spaced from said coiled water conducting tube to insulate said housing from heat generated by said electric heating means;

means, including a handle, attached to said water heater to facilitate manual movement thereof; and at least one access door removably attached to said housing, said access door being of adequate size to permit installation and maintenance of said coiled water conducting tube and said electric heating means.

8. The portable electric water heater of claim 7 including said housing being constructed of a material selected from the group of materials consisting of an aluminum alloy, thin sheet steel, heat resistant plastic and composite materials and wherein said thermal insulating means includes a thermal insulation blanket lining said housing and of adequate thickness to maintain the exterior surface of said housing sufficiently cool during use to permit touching by the human hand without injury thereto.

* * * * *